US006196102B1

(12) United States Patent
Granger

(10) Patent No.: US 6,196,102 B1
(45) Date of Patent: Mar. 6, 2001

(54) DEVICE FOR CONTROLLING THE ROTATION OF A SUPPORT DRUM IN A PAPER DISPENSING APPARATUS

(76) Inventor: Maurice Granger, 17 Rue Marcel Pagnol, 42270 Saint Priest en Jarez (FR)

( * ) Notice: Subject to any disclaimer, the term of this patent is extended or adjusted under 35 U.S.C. 154(b) by 0 days.

(21) Appl. No.: 09/125,056

(22) PCT Filed: Dec. 19, 1996

(86) PCT No.: PCT/FR96/02026

§ 371 Date: Aug. 4, 1998

§ 102(e) Date: Aug. 4, 1998

(87) PCT Pub. No.: WO97/24970

PCT Pub. Date: Jul. 17, 1997

(30) Foreign Application Priority Data

Jan. 3, 1996 (FR) ..... 96 00148

(51) Int. Cl.[7] ..... B26D 1/62
(52) U.S. Cl. ..... 83/335; 83/649; 83/949
(58) Field of Search ..... 83/298, 334, 335, 83/649, 949, 937, 337

(56) References Cited

U.S. PATENT DOCUMENTS

| | | | | |
|---|---|---|---|---|
| 3,896,691 | * | 7/1975 | Granger | 83/335 |
| 3,998,120 | * | 12/1976 | Granger | 83/335 |
| 4,062,257 | * | 12/1977 | Naert | 83/110 |
| 4,188,844 | * | 2/1980 | Deluca | 83/337 |
| 4,213,363 | | 7/1980 | Granger . | |
| 4,621,755 | * | 11/1986 | Granger | 225/96 |
| 5,048,386 | * | 9/1991 | Deluca | 83/37 |
| 5,078,033 | * | 1/1992 | Formon | 83/335 |
| 5,161,723 | | 11/1992 | Wirtz-Odenthal . | |
| 5,836,862 | | 11/1998 | Granger . | |
| 5,937,718 | * | 8/1999 | Granger | 83/334 |

FOREIGN PATENT DOCUMENTS

| | | |
|---|---|---|
| 0412169 | 2/1991 | (EP) . |
| 0483749 | 5/1992 | (EP) . |
| 2321443 | 3/1977 | (FR) . |
| 9111947 | 8/1991 | (WO) . |
| 95 26157 | 10/1995 | (WO) . |

* cited by examiner

*Primary Examiner*—Rinaldi I. Rada
*Assistant Examiner*—Melissa L. Hall
(74) *Attorney, Agent, or Firm*—Wall Marjama & Bilinski

(57) ABSTRACT

A folded/unfolded paper towel dispensing apparatus, includes a housing having a cover, a drum, an associated cutting device incorporated in the drum, and a tensioning device. An eccentric lever and a spring are used to actuate and reverse the direction of the drum, in which the upper part of the housing includes two flanges capable of accommodating a reel of paper towel. The drum and the tensioning device are secured between flanges located at right angles to the rear plane of the housing. The apparatus includes a device for controlling the rotation of the drum, fitted with a shaped lever hinged at its base in opposition to an elastic return spring, the upper part of the lever being fitted with a support shaft, supporting a pair of freely rotatable pulleys. A first pulley is associated through a drive belt with the drum and tensioning device before the paper is cut, and a second pulley is arranged so as to come into contact with the rear of the reel of material.

7 Claims, 4 Drawing Sheets

DEVICE FOR CONTROLLING THE ROTATION OF A SUPPORT DRUM IN A PAPER DISPENSING APPARATUS

FIELD OF THE INVENTION

The invention relates to the technical sector of apparatus for dispensing cellulose wadding, creped paper towels and towels of similar materials, especially those used for wiping the user's hands, toilet paper and paper napkins.

BACKGROUND OF THE INVENTION

The Applicant has developed several apparatus of this kind, and in particular an apparatus comprising a device for controlling and unwinding the reel of material as described in French patent application 95.01693. This patent described a device for braking the material take-off reel which was associated with the operating cycle of the apparatus involving rotation of the drum of one revolution, this device being hinged relative to the housing while ensuring, depending on whether or not the apparatus is operating, braking-action contact on at least one of the lateral sides of the reel or release of the latter when the drum rotates one cycle.

One of the problems encountered nevertheless remains the dimensions of the reels of material which are obtained from automated production processes. Indeed, the different reels which can be used according to the invention result from the manufacture of a long length of reel which is then cut into units by appropriate tools. On occasions, therefore, due to the equipment used, the transverse cuts of each reel are not performed with the utmost precision, so that when the reel is introduced into the paper dispensing apparatus there may be certain jamming effects or poor operation of the apparatus. This disadvantage is clearly evident when the paper strip is pulled by the user at an angle. Therefore, even when all the necessary precautions are taken in the design of automatic cutting tools, reels of material on occasions present a diameter differential of a few millimeters which affects the proper operation of the apparatus into which they are inserted.

As part of his research, the Applicant has developed different braking devices for reels of material which act laterally against the sides of the reel. Such devices cannot, however, be applied to the invention.

The Applicant has also developed, as part of his previous research on other types of paper-folding apparatus, a device to control the tension of the strip of paper so as to avoid buckling when the operator pulls the paper too hard. Such a device has notably been described in French patent No. 2647048, remarkable in that it comprised a hinged support frame comprising a rocking arm in the front part of the apparatus. This rocking arm is not, however, directly affected by the rotation of the drum of the cutting device so that its simplified function remains the control and absorption of a buckle of length of material when pulled too hard.

SUMMARY OF THE INVENTION

An object of the present invention is therefore to control the rotation of the roll or reel of material in order to overcome the above-mentioned problems. An aim of the present invention is to design a new device capable of controlling the unwinding of the reel of material without being restricted by how the sides of said reel have been cut, and of enabling easy and reliable dispensing of the strip of material.

Yet another aim of the invention is to design a simple system with a low manufacturing cost capable of being inserted, without any particular difficulty, into any single- or dual-roll, folded or unfolded, paper dispensing apparatus.

According to a first aspect of the invention, the folded/unfolded paper towel dispensing apparatus, of the type comprising a housing, a cover, a drum, a cutting device incorporated in the drum, a tensioning device as well as means of actuating and reversing the drum including an eccentric lever and a spring, the upper part of the housing having two flanges capable of accommodating a reel of paper towel, said drum and the tensioning device being secured between the flanges located at right angles to the rear plane of the housing, is remarkable in that it comprises a device for controlling the rotation of the drum, fitted with a shaped lever hinged at its base in opposition to an elastic return means, the upper part of said lever being fitted with a support shaft supporting a pair of freely-rotatable pulleys, and in that the first pulley is associated through a drive belt with one of the means of feeding and tensioning the paper before it is cut, and the second pulley is arranged so as to come into contact with the rear of the reel of material.

The advantages of the invention are clearly evident and the invention is remarkable for its simplicity. An additional advantage resulting from the invention resides in the easy loading of the reel of material. Indeed, when said reel is placed in the apparatus, it comes into contact with the roller pressing behind it, causing said reel to rotate, thus enabling the end of the strip of material to be presented in a plane located towards the drum and tensioning device. This is an additional advantage of interest for the person who loads the apparatus.

These aspects and others will become apparent from the following description.

DETAILED DESCRIPTION OF THE INVENTION

Figure 1:
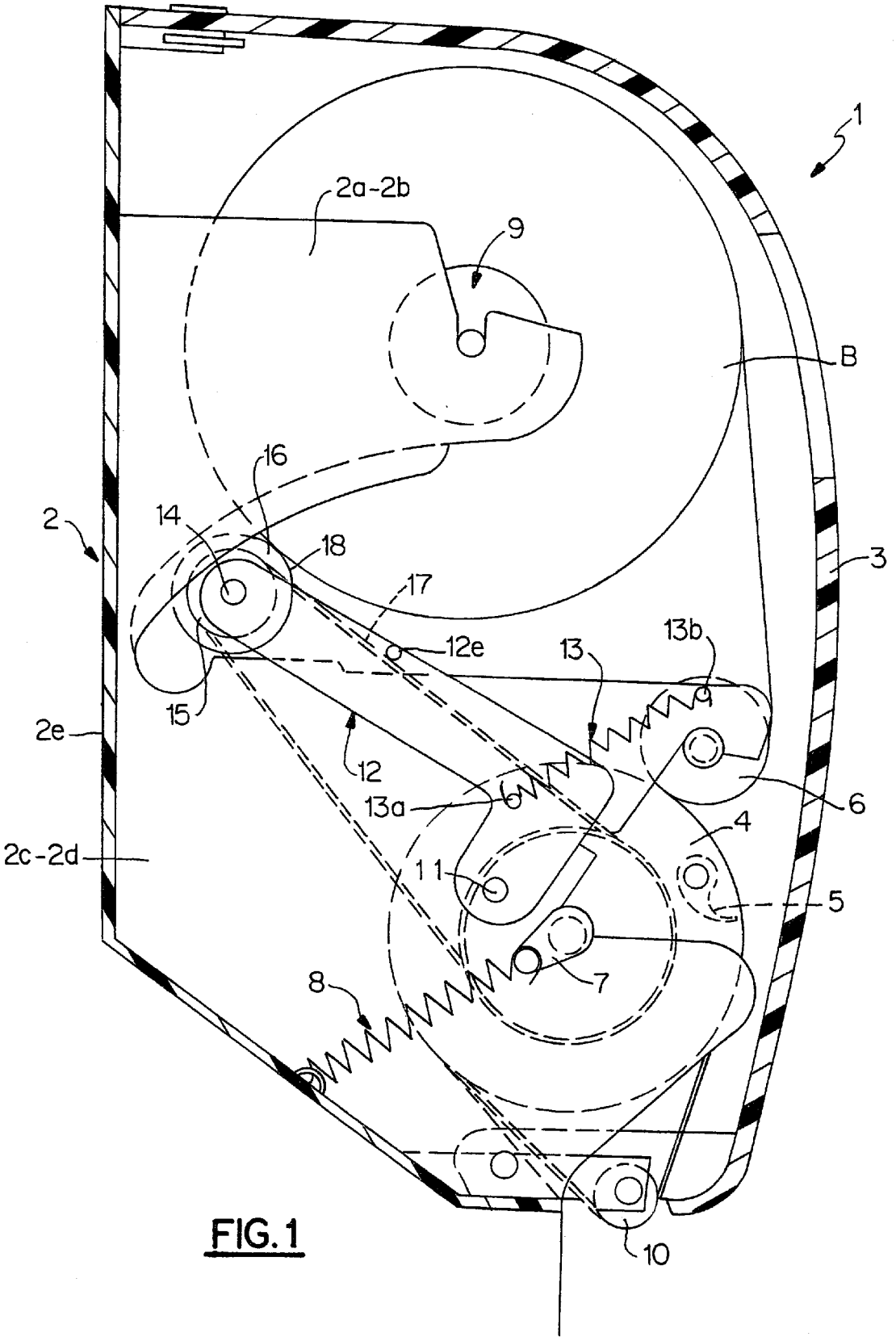
FIG. 1 is a cross-sectional view of a dispensing apparatus including the device for controlling the rotation of the reel of material.
Figure 2:
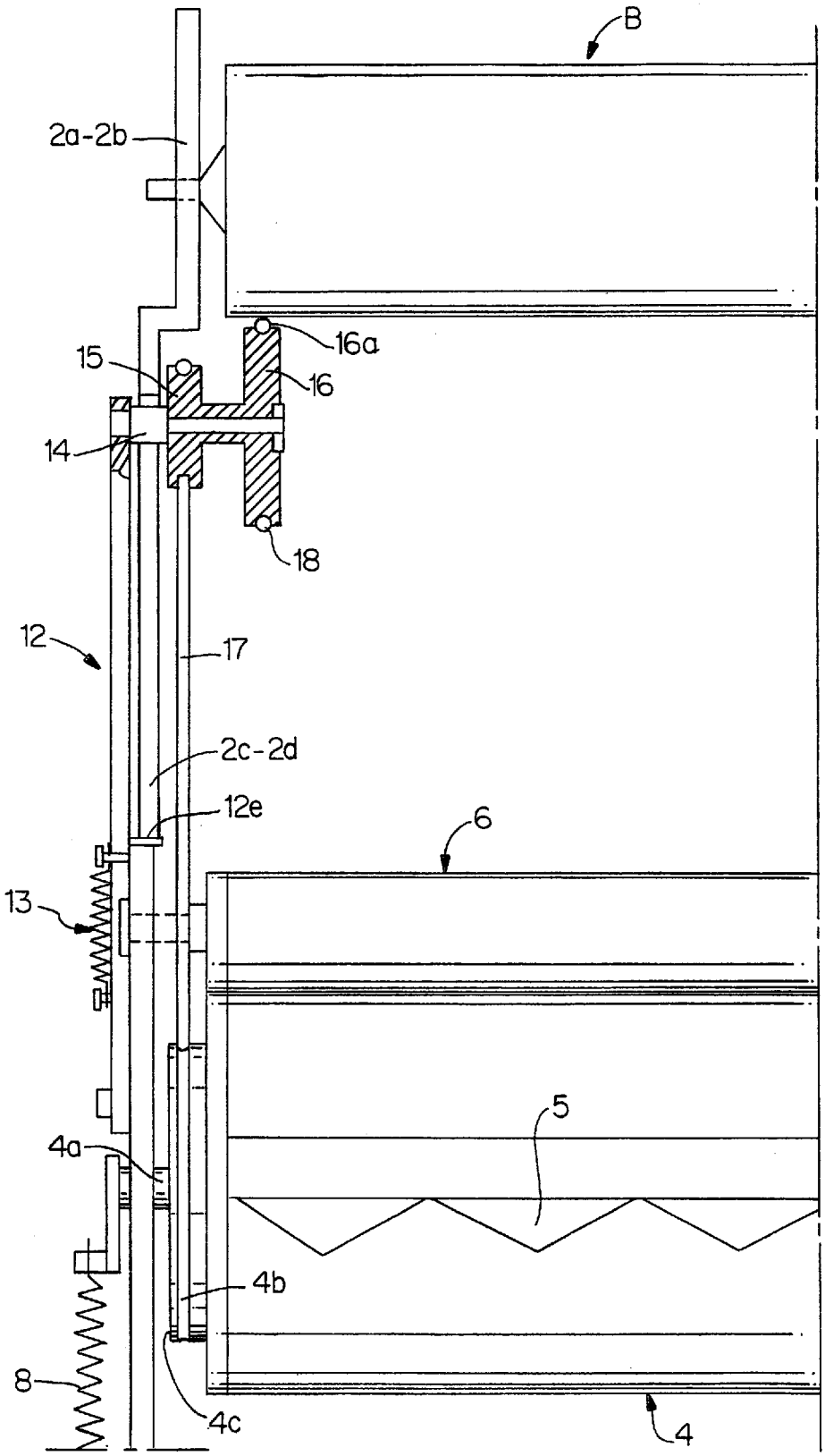
FIG. 2 is a sectional plan view along of FIG. 1, showing the position of the device for controlling the rotation of the reel of material in the idle state (apparatus not operating).
Figure 3:
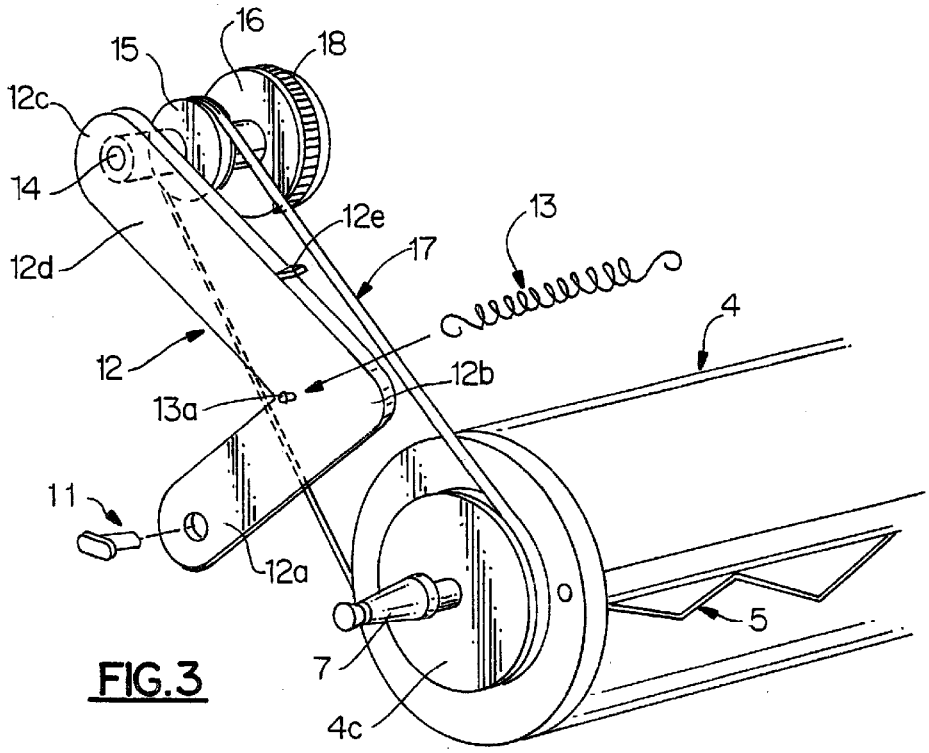
FIG. 3 is an enlarged partial view of the device according to the invention.

In order that the present invention may more readily be understood, the following description is given, merely by way of example, reference being made to the accompanying drawings.

The apparatus is referred to in its entirety as (1) and comprises a housing (2), a cover (3), a drum (4), a cutting device (5) incorporated in the drum, a tensioning device (6) as well as means of actuating and reversing the drum including an eccentric lever (7) and a spring (8). Apart from said spring, all of these components are made of plastic. The upper part of the housing has two flanges **(2*a*–2*b*) capable of accommodating a reel holder (9)** or end pieces for supporting a reel (B) of paper towel.

Drum (4) and the tensioning device are also secured between flanges (2*c*–2*d*) located at right angles to the rear plane (2*e*) of the housing. The drum comprises a shaft (4*a*) of which the ends extend to form, on the one hand, a control knob and, on the other hand, beyond receiving flange (2*c*), an eccentric lever (7) capable of cooperating with the actuating and return spring (8). Drum (4) and tensioning device (6) together enable the paper strip to pass and be fed behind the drum to be cut, the tensioning device pressing against the drum and both turning in a gear-like manner in opposite directions.

A follow-on roller (10) is located in the lower part of the housing, its purpose being notably, in a known manner, to protect the user's hands by being situated at the location where the paper is ejected from the apparatus, and to guide the ejection of the paper.

The device for controlling the rotation of the reel is referred to in its entirety as (12). It essentially comprises a bent lever which is hinged at its base by its short leg (12*a*) on lower flange (2*c*) which supports the drum and tensioning device. This lever is hinged around a shaft (11) fixed to the housing, in opposition to an elastic means of return (13) whose end (13*a*) is attached to the inner bent part (12*b*) of the lever, with its other end (13*b*) being fixed at the front of flange (2*c*). This return means in the form of a spring is subjected to tensile stress. At the upper end (12*c*) of its leg (12*d*), the lever is directly moulded with a support shaft (14) supporting two pulleys or rollers (15 and 16) rotatably-mounted on said support shaft. A first pulley (15), of small diameter, is capable of being located in the plane of a groove (4*b*) formed on a flange (4*c*) connected to the facing end of drum (4) to receive a belt (17) for driving and linking. The second pulley or roller (16) has a groove (16*a*) for receiving a toric ring (18) forming a means of friction with the reel of material. This second pulley (16) is capable of pressing against the rear of the reel of material (B) and thus acting as a brake. The two pulleys (15–16) are keyed onto the same shaft and are therefore rotated simultaneously. Other assembly means can be envisaged.

The reel of material, when housed in the apparatus, rests on lever (12) through pulley (16) and causes said lever to tip backwards in opposition to the aforementioned elastic return means (13). The lever's travel is therefore established over a distance corresponding at least to the initial diameter of the reel, enabling said reel to operate from the time it is installed until it is used up. Pulley (16) acting as a follow-on roller is at all times in contact with the reel of material due to the return effect exerted by the elastic means. A protruding limit stop (12*e*) is advantageously arranged on the upper edge of the lever to stop against the upper part of flange (2*c*).

The device according to the invention is extremely simple. It is easy to install and has a low manufacturing cost.

The advantage of the device lies in the fact that roller (16) is at all times in contact with the reel, and any rotation of said reel caused by the user pulling a piece of paper automatically causes the subjacent drum to rotate due to the driving action of the linking belt between the first pulley and the flange associated with the drum. The drum is therefore better rotated without being affected by any variations in the dimensions of the reel of material, in particular those of its transverse sides. Effort is minimal and there is no wear. Braking of reel rotation is automatic and buckling of a length of paper is avoided when it is excessively pulled, the buckle appearing between the reel and the drum upstream of the cutting device. The roller, pressing against the reel of material, in a way enables any play to be recuperated. This is obtained by the roller having a smaller diameter than the drum so that the difference enables the paper to remain permanently taut. This device is particularly advantageous in that it enables any desired strip of paper, including strips consisting of a single very thin, fragile layer, to be dispensed.

Figure 6:
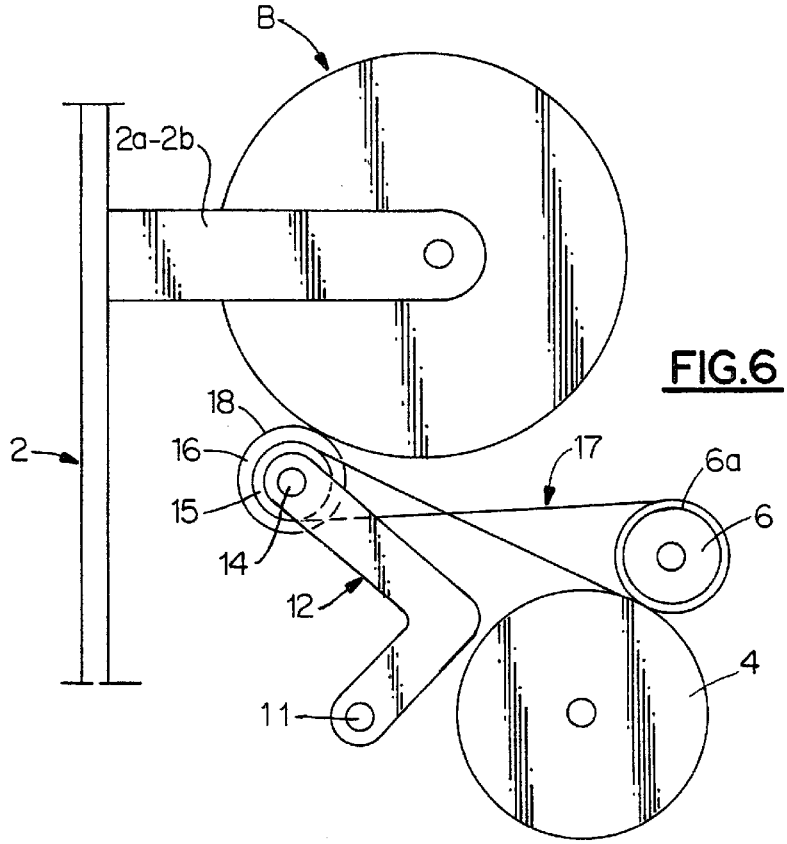
FIG. 6 is an alternative view of the drive belt cooperating with the tensioning device, the latter pressing against the drum.

Without going beyond the scope of the invention, the device can be arranged with the belt being coupled higher to the tensioning device (6) in contact with the drum, as shown in FIG. 6. In this configuration, belt (17) fits into groove (6*a*) of said tensioning device and is mounted crossed in order to rotate the drum in the same direction.

Figure 5:
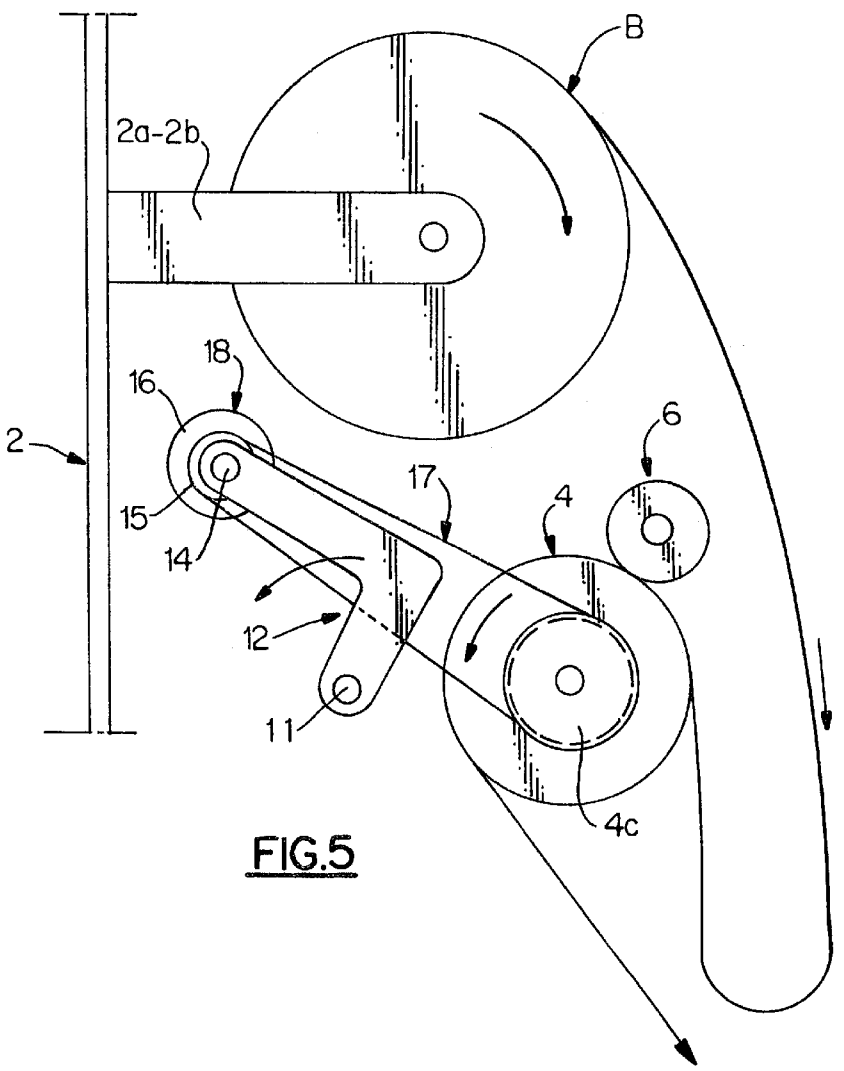
FIG. 5 is a schematic view without the in contact with the reel of material, showing buckling of the reel.
Figure 4:
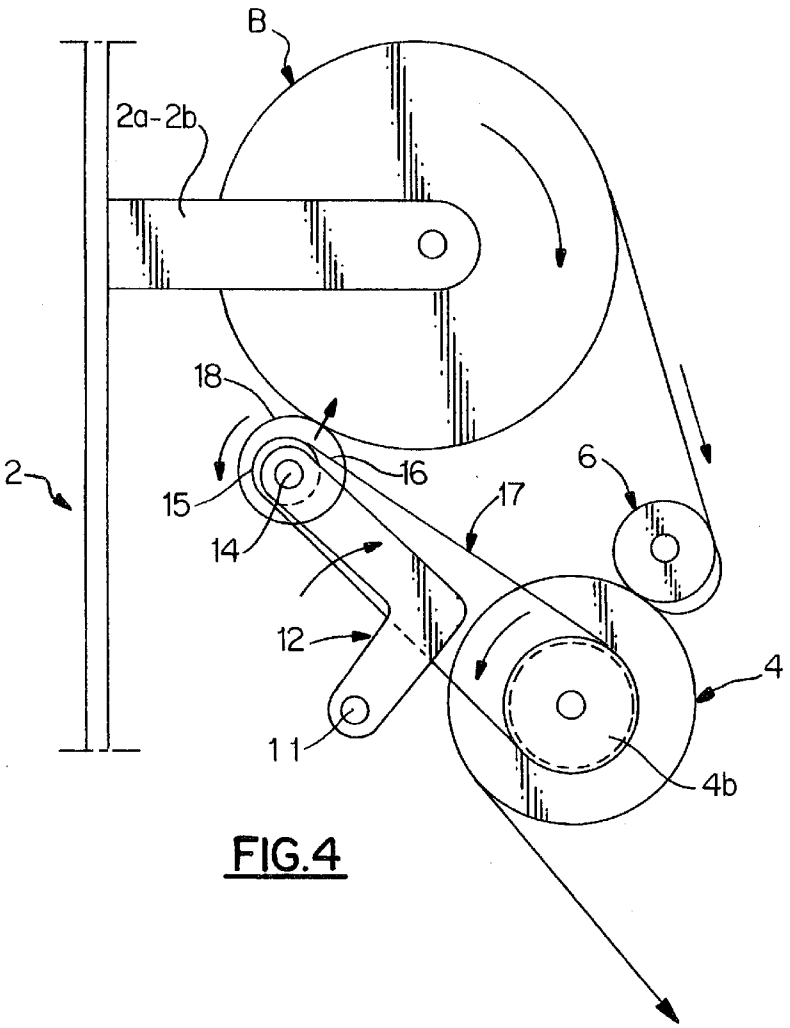
FIG. 4 is a schematic view of the device according to the invention.

Should the lever (12) be freed from contact against the reel of material, the strip of paper may buckle in the event of excessive pulling, as shown in FIG. 5, thus representing the prior art.

What is claimed is:

1. An apparatus for dispensing folded and unfolded paper towels comprising:

a housing having a cover, said housing having an upper part and a lower part;

a drum;

a cutting device incorporated in the drum;

a tensioning device;

means of actuating and reversing the drum, said actuating and reversing means including an eccentric lever and a spring, wherein the upper part of the housing includes two upper flanges capable of accommodating a reel of paper material therebetween, said drum and the tensioning device being secured between a pair of lower flanges located at right angles to a rear plane of the housing, said dispensing apparatus including a device for controlling the rotation of the drum, said device including a shaped lever hinged at its base in opposition to an elastic return means, an upper part of said lever being fitted with a support shaft for supporting a pair of freely-rotatable pulleys, said pair of pulleys including a first pulley associated through a drive belt with one of said drum and said tensioning device before a portion of said paper towel from said reel is cut, and a second pulley arranged so as to come into contact with the rear of the reel of material.

2. Apparatus as claimed in claim 1, wherein the second pulley has a groove for receiving a toric ring for providing friction with the reel of paper material and for permitting rotation thereof.

3. Apparatus as claimed in claim 1, wherein the shaped lever has a short leg hinged on one of said lower flanges supporting the drum and tensioning device, said elastic return means having an end which is attached to a lower bent part of the shaped lever, the other end of said elastic return means being fixed to said lower flange.

4. Apparatus as claimed in claim 3, wherein the upper part of said shaped lever is hingably movable so as to allow the toric ring to remain in contact with the reel of paper material from an initial diameter of the reel of paper material to a second smaller diameter in which the paper material is depleted from the reel.

5. Apparatus as claimed in claim 4, wherein the shaped lever has a protruding limit stop on an upper edge thereof to stop against an upper part of one of the lower flanges.

6. Apparatus as claimed in claim 1, wherein said drum presents, at one end thereof, a flange defining a groove to receive the drive belt.

7. Apparatus as claimed in claim 1, wherein the first pulley is associated with the drum through said tensioning device, said drive belt being fitted into a groove of the tensioning device and mounted in a figure-eight configuration in order to rotate the drum in a paper unwinding direction.

* * * * *